US008770923B2

(12) United States Patent
Stewart

(10) Patent No.: US 8,770,923 B2
(45) Date of Patent: Jul. 8, 2014

(54) FAN ASSEMBLY

(76) Inventor: Richard Stewart, Springfield, OH (US)

( * ) Notice: Subject to any disclaimer, the term of this patent is extended or adjusted under 35 U.S.C. 154(b) by 981 days.

(21) Appl. No.: 12/559,661

(22) Filed: Sep. 15, 2009

(65) Prior Publication Data

US 2010/0068038 A1 Mar. 18, 2010

Related U.S. Application Data

(60) Provisional application No. 61/096,920, filed on Sep. 15, 2008.

(51) Int. Cl.
*F03B 3/06* (2006.01)

(52) U.S. Cl.
USPC ..... 415/129; 416/150; 416/246

(58) Field of Classification Search
USPC ..... 416/246, 147, 150; 415/129
See application file for complete search history.

(56) References Cited

U.S. PATENT DOCUMENTS 1,078,609 A 11/1913 Chaney
2,378,361 A 6/1945 Miller
3,776,122 A * 12/1973 Julian ..... 454/228
5,256,039 A * 10/1993 Crawford ..... 417/234
6,126,415 A * 10/2000 Lasko ..... 417/423.15
2005/0174910 A1* 8/2005 Lee ..... 369/53.37
2009/0087311 A1* 4/2009 Wyborn ..... 416/9

* cited by examiner

*Primary Examiner* — Edward Look
*Assistant Examiner* — William Grigos
(74) *Attorney, Agent, or Firm* — L.C. Begin & Associates, PLLC.

(57) ABSTRACT

One embodiment of a fan assembly includes a housing having a base member and a lip member extending outwardly from the base member for defining an enclosure. The fan assembly may further include a toothed track assembly, a wheel assembly, a first motor, a second motor, and a fan member. The toothed track assembly includes a toothed track member disposed within the enclosure. The wheel assembly includes a pair of toothed wheels adapted to move on the toothed track member. The first motor is operatively coupled to the wheel assembly and is capable of rotating the pair of toothed wheels. The fan member is coupled to the wheel assembly, such that the fan member moves along the toothed track member when the first motor rotates the pair of toothed wheels on the toothed track member. The second motor is operatively coupled to the fan member for rotating the fan member.

16 Claims, 2 Drawing Sheets

FAN ASSEMBLY

CROSS REFERENCE TO RELATED APPLICATION

The present disclosure claims priority under 35 United States Code, Section 119 from the U.S. Provisional Patent Application Ser. No. 61/096,920 filed on Sep. 15, 2008 the disclosure of which is incorporated by reference.

FIELD OF THE DISCLOSURE

The present disclosure generally relates to electric equipments, and more particularly, to a fan assembly.

BACKGROUND OF THE DISCLOSURE

Electric fans are in widespread use to circulate air during hot and humid conditions. Further, as the climate is constantly getting affected by pollution, tree cutting activities, and other global warming factors, the demand for electric fans has increased.

Examples of the electric fans that are used for circulating air include, but are not limited to, ceiling fans. Ceiling fans typically provide reasonable air circulation and distribution in an area, such as an area of a room of a building. However, a user occupying a portion of the area may still not be able to receive a sufficient air flow during extreme hot and humid conditions. Further, a lot of arrangements need to be made when a ceiling fan is installed on a ceiling of an area. Furthermore, elaborate mounting hardware is installed to support and provide power to the ceiling fans. The complexity of installing such elaborate mounting hardware renders the re-installation of the ceiling fans at a new location extremely difficult.

To overcome such limitations, stationary table fans and the like have been used by a number of people to receive uniform and directional air flow. However, use of conventional stationary fans may involve somewhat large manual effort by a user. Specifically, a user may need to adjust position of a conventional stationary fan according to his or her comfort, and this entails considerable manual effort by the user due to the bulky structure of the conventional stationary fan. Accordingly, it may become somewhat difficult to move the conventional stationary fan while adjusting its position. Additionally, cumbersome power cords connected to a conventional stationary fan must be re-routed and re-adjusted when the conventional stationary fan is re-positioned. Furthermore, such fans are inefficient as they are incapable of providing a well-distributed air flow in a large area.

Accordingly, oscillating fans, such as oscillating table fans, have been employed in order to provide uniformly distributed air in a specific area. However, conventional oscillating fans are also quite bulky. Therefore, such conventional oscillating fans occupy a large space in a specific area. Further, it can be somewhat difficult to carry the conventional oscillating fans while re-positioning, as per a user's requirements.

Moreover, many individuals use multiple conventional electric fans, such as stationary and oscillating fans, to receive a well-distributed and large volume flow of air. Of course, the greater number of electric fans may increase energy costs.

In general, most of the aforementioned conventional electric fans are provided in the form of a fan assembly that includes a fan, a cover, and other installation components including elaborate mounting hardware. However, such fan assemblies may be made of heavy weight materials, and accordingly, it may be inconvenient to carry the fan assemblies to another location.

SUMMARY OF THE DISCLOSURE

One embodiment of a fan assembly may include a housing having a base member with a periphery. The housing may also have a lip member that may extend outwardly from the periphery to define an enclosure therebetween. The fan assembly may further include a toothed track assembly that may have a toothed track member disposed within the enclosure of the housing. The fan assembly may further include a wheel assembly that may have a pair of toothed wheels that may be adapted to move on the toothed track member. The fan assembly may also include a first motor that may be operatively coupled to the wheel assembly, such that the first motor may be capable of rotating the pair of toothed wheels in one of a first direction and a second direction opposite to the first direction on the toothed track member. In addition, the fan assembly may also include a fan member that may be coupled to the wheel assembly, such that the fan member may move along the toothed track member when the first motor rotates the pair of toothed wheels on the toothed track member. Further the fan assembly may include a second motor that may be operatively coupled to the fan member to rotate the fan member.

BRIEF DESCRIPTION OF THE DRAWINGS

These and other features and advantages of the present invention will be apparent from the following detailed description of preferred embodiments and best mode, appended claims, and accompanying drawings in which:

Like reference numerals refer to like parts throughout the description of the drawings.

DETAILED DESCRIPTION OF THE DISCLOSURE

For a thorough understanding of the present disclosure, reference is to be made to the following detailed description, including the appended claims, in connection with the above-described drawings. Although the present disclosure is described in connection with exemplary embodiments, the present disclosure is not intended to be limited to the specific forms set forth herein. It is understood that various omissions and substitutions of equivalents are contemplated as circumstances may suggest or render expedient, but these are intended to cover the application or implementation without departing from the spirit or scope of the claims of the present disclosure. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

The term "first," "second," and the like, herein do not denote any order, elevation or importance, but rather are used to distinguish placement of one element over another. Further, the terms, "a" and "an" herein do not denote a limitation of quantity, but rather denote the presence of at least one of the referenced item. Unless limited otherwise, the terms "attached," "connected," "coupled," and variations thereof herein are used broadly and encompass direct and indirect attachments, connections, and couplings.

The present disclosure provides a fan assembly that circulates air in one or more directions as specified by a user thereof. Specifically, the fan assembly may include a fan member that may be capable of moving along a toothed track assembly to provide a well-distributed flow of air in a specific area, such as a room of a building.

Figure 1:
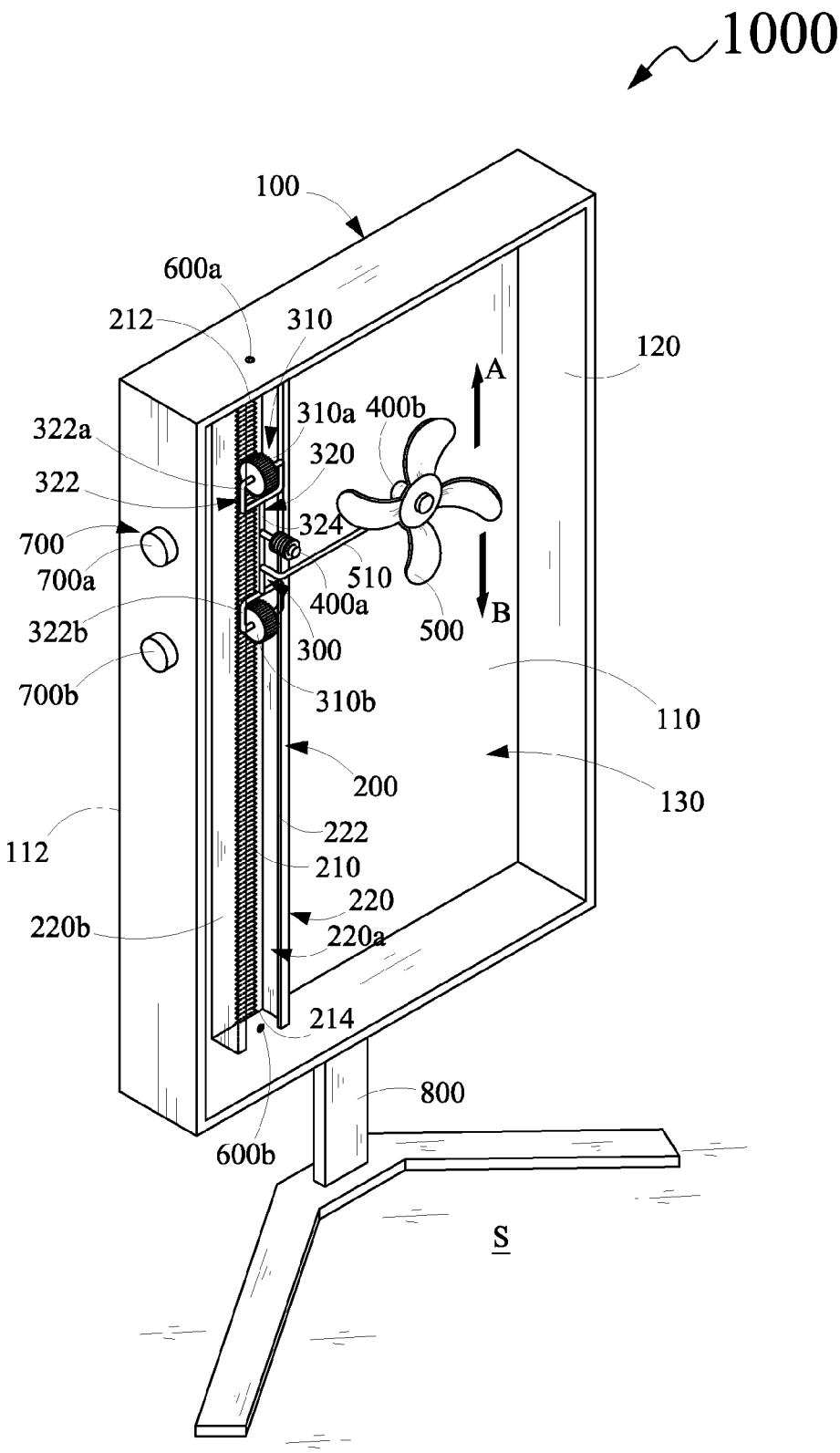
FIG. 1 is a perspective view of one embodiment of a fan assembly.

Referring to FIG. 1, one embodiment of a fan assembly 1000 may include a housing 100 having a base member 110, which in this form may be a planar member with a periphery 112. The housing 100 may also have a lip member 120, which in this form may be a plurality of walls extending perpendicularly from the periphery 112 to define an enclosure 130 therebetween. The base member 110 and the lip member 120 may be made of a light weight material. Suitable examples of the light weight material include, but are not limited to, a metallic material, a plastic material, and a wooden material. Further, as shown in FIG. 1, the housing 100 may be rectangular in shape. However it would be evident to a person skilled in the art that the housing 100 may be configured to assume any other shape without deviating from the scope of the present disclosure.

The fan assembly 1000 may further include a toothed track assembly 200. The toothed track assembly 200 in this form may have a toothed track member 210, which may be an elongated toothed structure having a plurality of teeth (not numbered). Further, the toothed track member 210 may have a first end portion 212 and a second end portion 214 opposite to the first end portion 212, as shown in FIG. 1. Furthermore, the toothed track member 210 may be composed of a light weight material, such as a light weight metallic material and a light weight plastic material. It should be evident that the toothed track member 210 may be composed of any other suitable light weight material.

The toothed track assembly 200 may also have a pair of engagement rails 220, which may include, for example, a first engagement rail 220*a* and a second engagement rail 220*b*. The engagement rails 220 may be configured in the form of elongated supporting structures and may be adapted to confine the toothed track member 210 therewithin. Accordingly, the engagement rails 220 may have lengths equivalent to that of the toothed track member 210. Further, each engagement rail 220 may include an elongated channel 222.

As shown in FIG. 1, the toothed track assembly 200 may be disposed within the housing 100. Specifically, the toothed track member 210 may be disposed within the housing 100 along the periphery 112 of the base member 110. The engagement rails 220 may extend upwardly from the base member 110 and may be disposed along a length of the toothed track member 210 within the housing 100. Of course, the toothed track assembly 200 may have any other configuration without deviating from the scope of the present disclosure.

The fan assembly 1000 may also have a wheel assembly 300, which in one form may include a pair of toothed wheels 310, such as a first toothed wheel 310*a* and a second toothed wheel 310*b*. The toothed wheels 310 may mesh and engage with the toothed track member 210 and may be adapted to move on the toothed track member 210. The first toothed wheel 310*a* may be coupled to the second toothed wheel 310*b* through an engagement mechanism 320. The engagement mechanism 320 may include a pair of connectors, such as a pair of "C" shaped eyelets 322, and a first shaft member 324. The pair of "C" shaped eyelets 322 may include a first "C" shaped eyelet 322*a* and a second "C" shaped eyelet 322*b* that may be coupled to each other via the first shaft member 324, as shown in FIG. 1. Further, the first "C" shaped eyelet 322*a* may be connected to the first toothed wheel 310*a*, and the second "C" shaped eyelet 322*b* may be connected to the second toothed wheel 310*b*, as shown in FIG. 1. Respective portions (not numbered) of the pair of "C" shaped eyelets 322 may be slidably coupled with the pair of elongated channels, such as the elongated channel 222. Such an arrangement facilitates the wheel assembly 300 to be retained within the toothed track assembly 200, with the toothed wheels 310 meshed and engaged with the toothed track member 210.

The fan assembly 1000 may further include a first motor 400*a*, which may be operatively coupled to the wheel assembly 300. Specifically, the first motor 400*a* may be operatively coupled to the first shaft member 324. The first motor 400*a* may be capable of rotating the toothed wheels 310 in one a first direction, as indicated by arrow 'A', or a second direction, as indicated by arrow 'B' opposite to the first direction 'A'. Specifically, as the first motor 400*a* rotates in an initial direction, the wheel assembly 300 may start moving on the toothed track assembly 200 and may assume a plurality of positions on the toothed track assembly 200. For the purpose of this example only, the toothed wheels 310 may move in the first direction 'A' on the toothed track member 210 until the toothed wheels 310 reach the first end portion 212 of the toothed track member 210. In a particular embodiment, first motor 40*a* is a stepper motor.

The fan assembly 1000 may further have a pair of sensors, which may be electrically coupled to the first motor 400*a*. The sensors may include a first sensor 600*a* that may be installed at the first end portion 212 of the toothed track member 210, and a second sensor 600*b* that may be installed at the second end portion 214 of the toothed track member 210. When the toothed wheels 310 reach the first end portion 212, the first sensor 600*a* may transmit a first signal to the first motor 400*a* to start rotating in an opposite direction. The first motor 400*a* may receive the first signal transmitted by the first sensor 600*a*, and accordingly, the first motor 400*a* may start rotating in the opposite direction, thereby enabling the wheel assembly 300 to move in the second direction 'B'. Similarly, when the toothed wheels 310 reach the second end portion 214, the second sensor 600*b* may transmit a second signal to the first motor 400*a* to again start rotating in the initial direction. The first motor 400*a* may receive the second signal transmitted by the second sensor 600*b*, and accordingly, the first motor 400*a* may start rotating in the initial direction, thereby enabling the wheel assembly 300 to again move in the first direction 'A'.

The fan assembly 1000 may further include a fan member 500, which may be coupled to the wheel assembly 300 via a second shaft member 510. The second shaft member 510 may extend from a base portion (not numbered) of the fan member 500 and may couple with the first shaft member 324 of the wheel assembly 300. The fan member 500 may move along the toothed track assembly 200 when the first motor 400*a* starts rotating the toothed wheels 310. The fan member 500 in this form may be a compact fan.

Furthermore, the fan assembly 1000 may further include a second motor 400*b* that may be operatively coupled to the fan member 500. The second motor 400*b* may be capable of rotating the fan member 500. Further, the first motor 400*a* and the second motor 400*b* may include windings or solenoid (not shown).

The fan assembly 1000 may further include a plurality of control knobs 700, such as a first control knob 700*a* and a second control knob 700*b*, carried by the housing 100. Specifically, the control knobs 700 may be carried by the lip member 120 of the housing 100. However, the control knobs 700 may be carried by other portions the housing 100. The first control knob 700*a* may be electrically coupled with the first motor 400*a*, and may be capable of regulating the first motor 400*a* for controlling a speed of rotation of the toothed wheels 310. Specifically, the first control knob 700*a* may control an amount of current passing through the solenoid present in the first motor 400*a* for controlling the speed of rotation of the first motor 400*a*. Therefore, the first control knob 700*a* may enable a user to move the fan member 500 in toward one end of the toothed track member 210 or the other end. Further, the second control knob 700*b* may be electrically coupled with the second motor 400*b*, and may be capable of regulating the second motor 400*b* for controlling a speed of rotation of the fan member 500. Specifically, the second control knob 700*b* may control an amount of current passing through the solenoid present in the second motor 400*b* for controlling the speed of rotation of the second motor 400*b*. Furthermore, the control knobs 700 may enable the fan member 500 to rotate at a stationary position within the housing 100.

In addition, the fan assembly 1000 may include a supporting member 800. The supporting member 800 may be configured in the form of a two-pronged stand. Further, the supporting member 800 may be removably attached to the housing 100 for supporting the housing 100 on a surface 'S'. For example, the supporting member 800 may be removably attached to a portion (not numbered) of the lip member 120 for supporting the housing 100 in a vertical position on the surface 'S', as shown in FIG. 1. Further, the supporting member 800 may be removably attached to the housing 100 using fasteners, such as nuts and bolts. However, the supporting member 800 may be removably attached to the housing 100 using any other mechanism known in the art. Of course, the housing 100 may be placed horizontally as desired. Accordingly, the supporting member 800 may be removably attached to another portion of the lip member 120 in order to orient the housing 100 in a horizontal position. Alternately, the supporting member 800 may be removed from the fan assembly 1000, and the fan assembly 1000 may then be mounted on a wall with the help of mechanisms, which are known in the art.

Figure 2:
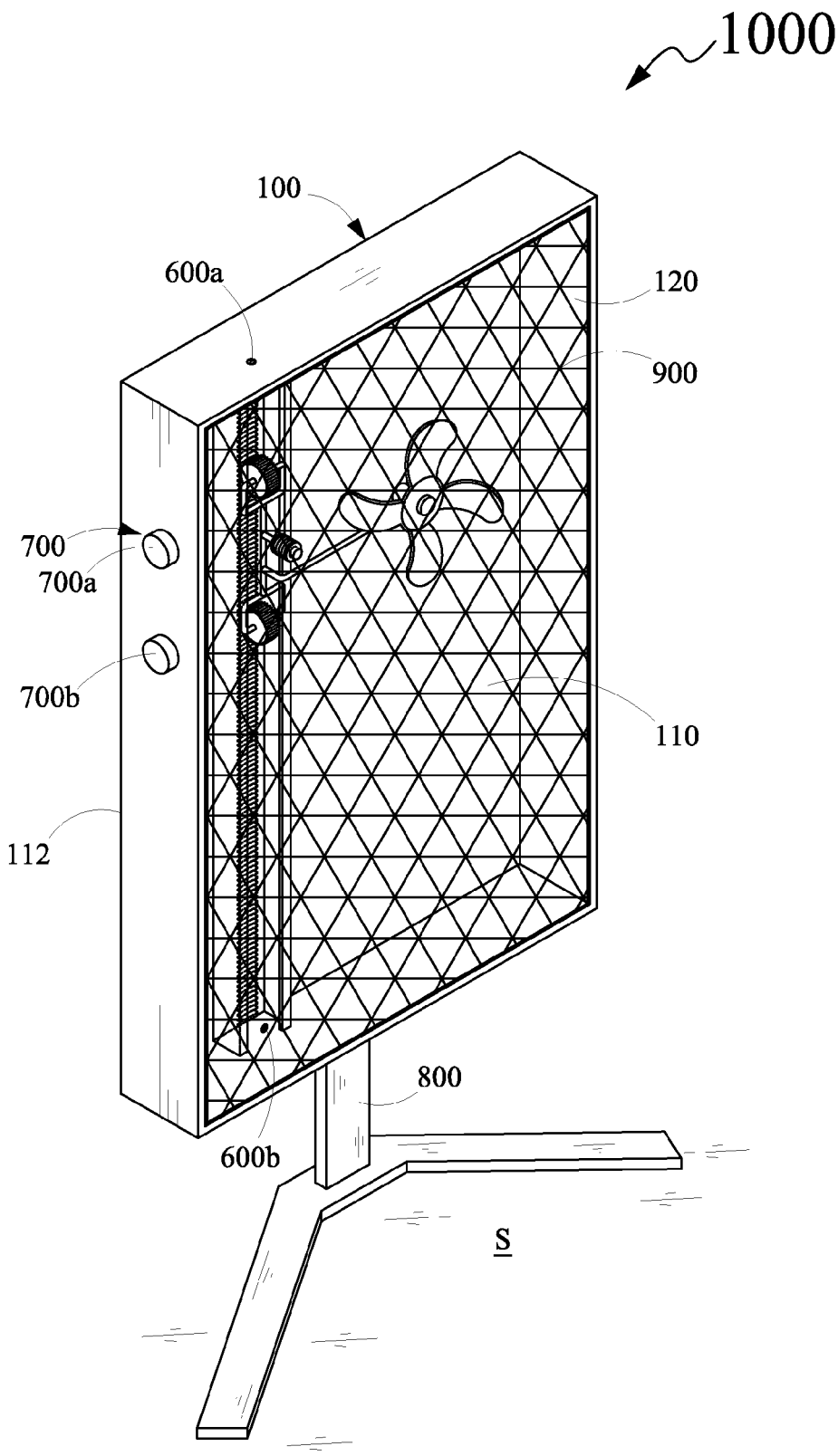
FIG. 2 is a perspective view of the fan assembly of FIG. 1 with a cover member.

Referring now to FIG. 2, there is shown a perspective view of the fan assembly 1000 with a cover member 900. For the purpose of this description only, the cover member 900 may be removably attached to the lip member 120 of the housing 100 to cover the enclosure 130. For example, the cover member 900 may be snugly fitted within the lip member 120. The cover member 900 may be used to protect the toothed track assembly 200, the wheel assembly 300, the first motor 400*a*, the fan member 500, the second motor 400*b*, the first sensor 600*a*, and the second sensor 600*b*. Further, the cover member 900 in one form may be a lattice-shaped frame that is rectangular in shape. However, the cover member 900 may instead be configured to assume any other shape or structure without deviating from the scope of the present disclosure.

The fan assembly 1000 of the present disclosure may include mechanisms for receiving power from a source for energizing the first motor 400*a* and the second motor 400*b*. Further, the fan assembly 1000 may also include mechanisms such as amplifiers to boost the power received from the source.

In the present embodiment, the fan assembly 1000 has a dimension with a height of about 41 inches, a width of about 18 inches, and a thickness of about 3½ inches, when placed vertically. However, it will be evident to a person skilled in the art that the fan assembly 1000 may be configured to have any other dimension.

The present disclosure provides a fan assembly, such as the fan assembly 1000, which offers the following advantages. The fan assembly has a simple structural configuration that makes the fan assembly cost-effective. Further, the to and fro motion of the fan member on the toothed track member enables the fan assembly to circulate air in one or more directions as specified by a user. Furthermore, the fan assembly is portable and may be conveniently transported from one location to another. In addition, the fan assembly, due to a compact structure thereof, may be conveniently arranged and installed at any suitable location while occupying less space. Moreover, the fan assembly may be used in radiators of automobiles, such as cars and trucks; televisions; and other electronic devices, for cooling a heat sink.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the claims of the present disclosure.

What is claimed is:

1. A fan assembly comprising:

a housing comprising, a base member, and a lip member extending outwardly from a periphery of the base member for defining an enclosure therebetween;

a toothed track assembly disposed within the enclosure of the housing, the toothed track assembly comprising a toothed track member;

a wheel assembly comprising a pair of toothed wheels disposed within the enclosure of the housing and adapted to move on the toothed track member;

a first motor disposed within the enclosure of the housing and operatively coupled to the wheel assembly, the first motor being capable of rotating the pair of toothed wheels in one of a first direction and a second direction opposite to the first direction on the toothed track member;

a fan member disposed within the enclosure of the housing and coupled to the wheel assembly, such that the fan member moves along the toothed track member when the first motor rotates the pair of toothed wheels on the toothed track member; and a second motor disposed within the enclosure of the housing and operatively coupled to the fan member for rotating the fan member.

2. The fan assembly of claim 1, wherein the toothed track has a single row of teeth, and wherein the toothed wheels of the wheel assembly are rotatably mounted so as to be spaced apart along the single row of teeth.

3. The fan assembly of claim 2 wherein the first motor is positioned between the toothed wheels of the pair of toothed wheels of the wheel assembly.

4. The fan assembly of claim 1 wherein the wheel assembly comprises an engagement mechanism connecting the toothed wheels of the pair of toothed wheels.

5. The fan assembly of claim 3 wherein the engagement mechanism comprises a first connector connected to a first toothed wheel of the pair of toothed wheels, a second connector connected to a second toothed wheel of the pair of toothed wheels, and a first shaft member connecting the first and second connectors.

6. The fan assembly of claim 5, wherein the first and second connectors comprise respective first and second "C" shaped eyelets.

7. The fan assembly of claim 6 wherein the track assembly comprises a pair of opposed engagement rails, and wherein each of the first and second "C" shaped eyelets is slidably coupled to a respective engagement rail of the pair of engagement rails.

8. The fan assembly of claim 4, wherein the first motor is attached to the engagement mechanism.

9. The fan assembly of claim 1, wherein the toothed wheels are positioned so as to move within the housing.

10. The fan assembly of claim 1 wherein an axis of rotation of the fan member is spaced apart from an axis of motion of the wheel assembly along the track member.

11. A fan assembly comprising:

a housing;

a fan member positioned within the housing; and fan member moving means contained within the housing, the moving means including a track member positioned within the housing, and a motor positioned within the housing and operatively coupled to the fan member and to the track member for moving the fan member along the track member from a first location within the housing to a second location within the housing different from the first location.

12. The fan assembly of claim 11 wherein the fan member moving means further comprises a wheel assembly contained within the housing and operatively coupled to the track member and to the motor so as to be moveable by the motor along the track member and wherein the fan member is coupled to the wheel assembly so as to move with the wheel assembly.

13. The fan assembly of claim 11 wherein the track member has a single row of teeth.

14. The fan assembly of claim 13 wherein the fan member is movably mounted within the housing so as to direct a flow of air from the fan member in a first direction, and wherein the teeth of the single row of teeth extend from the track member in the first direction.

15. The fan assembly of claim 13 wherein the wheel assembly includes a first toothed wheel and a second toothed wheel aligned with each other so as to engage the single row of teeth during movement of the wheel assembly.

16. The fan assembly of claim 11 wherein the fan assembly is a man-portable fan assembly.

* * * * *

UNITED STATES PATENT AND TRADEMARK OFFICE

CERTIFICATE OF CORRECTION

PATENT NO. : 8,770,923 B2
APPLICATION NO. : 12/559661
DATED : July 8, 2014
INVENTOR(S) : Stewart It is certified that error appears in the above-identified patent and that said Letters Patent is hereby corrected as shown below:

In the Specification

Column 4; Line 12; Please delete "one".

Signed and Sealed this
Thirtieth Day of September, 2014

Michelle K. Lee

Michelle K. Lee
*Deputy Director of the United States Patent and Trademark Office*